United States Patent [19]

Schwartz

[11] 3,930,376

[45] Jan. 6, 1976

[54] ICE CUBE TRAY

[75] Inventor: Anton J. Schwartz, Worthington, Ohio

[73] Assignee: White-Westinghouse Corporation, Cleveland, Ohio

[22] Filed: Jan. 23, 1975

[21] Appl. No.: 543,291

[52] U.S. Cl. ..... 62/320; 62/344; 249/72; 249/69; 249/131; 249/127

[51] Int. Cl.[2] ..... F25C 1/24; F25C 5/18

[58] Field of Search ..... 249/71, 72, 119, 125, 127, 249/69, 128, 129, 130, 131, 203, 132, 133; 62/320, 344

[56] References Cited

UNITED STATES PATENTS

| | | | |
|---|---|---|---|
| 2,433,211 | 12/1947 | Gits | 249/127 |
| 2,463,947 | 3/1949 | Buchanan | 249/72 |
| 2,481,525 | 9/1949 | Mott | 249/127 |
| 2,496,331 | 2/1950 | Buchanan | 249/72 |
| 2,799,998 | 7/1957 | Pappas | 249/72 X |
| 3,033,008 | 5/1962 | Davis | 249/131 X |
| 3,170,308 | 2/1965 | Cucuzza | 62/320 |
| 3,386,698 | 6/1968 | Albright | 249/131 X |
| 3,844,525 | 10/1974 | Parmett | 249/127 |

*Primary Examiner*—J. Howard Flint, Jr.
*Attorney, Agent, or Firm*—Strauch, Nolan, Neale, Nies & Kurz

[57] ABSTRACT

A pair of diametrically opposed protuberances, comprising inwardly projecting bumps, extend from the otherwise smooth surface of opposite corners of adjoining side walls of the generally cubical pockets in an ice cube tray. These protruberances, define stress concentration areas at the corners of the frozen cubes which, when the plastic tray is twisted to release the cubes therefrom, cause the cubes to fracture and alter their configuration to the extent that they are prevented, either because of their enlarged outward dimensions or because of ice particles that have flaked therefrom and are in an interferring position, from being reseated in the tray in the as-molded position. Thus, each cube remains elevated from its original position with the side walls of each cube spaced somewhat from the side walls of the mold for relatively easy individual removal.

4 Claims, 5 Drawing Figures

ICE CUBE TRAY

BACKGROUND OF THE INVENTION

1. Field of the Invention

The invention relates to well known plastic molded generally flexible ice cube trays and more particularly to such a tray having protruberances on opposing corners of each individual ice cube forming pocket to alter the ice cube upon its release from the tray to the extent that it will not be reseated in the tray in its as-molded orientation.

2. Description of the Prior Art

Flexible plastic ice cube trays are well known in the prior art. Such flexible trays have the advantage of being relatively inexpensively molded from a plastic such as polypropylene that easily releases the ice cubes once the initial adhesion force established during freezing is broken. To do this, the tray is generally grasped at each end and twisted to the extent there is sufficient flexing of each individual pocket to release the cube. However, after such flexing, if the cubes are to remain in the tray as opposed to the tray being dumped into a separate storage bin, the cubes settle back into their respective pockets and assume the as-molded orientation providing generally continuous smooth surfaces between the tray and the ice cubes making it difficult to manually grasp any individual cube to remove it.

One manner of altering the cube orientation with respect to the pocket of an ice cube tray is to utilize the expansive forces of freezing to move the cube to an accessible position with respect to the tray while it remains therein. Such is shown in U.S. Pat. Nos. 3,025,682 and 2,704,927.

The present invention however, provides certain stress concentrating structure in each pocket so that upon flexing the tray each individual cube is caused to fracture to the extent its outward dimension is altered so that it will not be reseated in its as-molded orientation. This produces a generally discontinuous surface between the cubes and the tray permitting each cube to be individually grasped.

SUMMARY OF THE INVENTION

The invention shows an improved ice cube tray of the well known molded flexible plastic type having individual pockets with outwardly diverging side walls. Protruberances extend inwardly from a pair of diagonally opposed corners of the pocket walls. The protruberances provide stress concentration areas in the corners of the cube when a tray is flexed to dislodge the cube. The stress at such areas is sufficient to alter the outward dimensions of the cube upon its release to the extent it is prevented from reseating itself within the pocket in the as-molded position but remains in a somewhat elevated position for accessibility.

DESCRIPTION OF THE PREFERRED EMBODIMENT

The present invention is directed to an improvement in an ice tray whose construction, except for the improvement, is otherwise generally known and commercially available. In accordance therewith, the tray generally comprises a grid-like array of unitary molded individual pockets, molded from a plastic such as polyethylene or polypropylene to provide a generally flexible structure capable of easy release of the ice cubes molded therein. The release of the cubes is generally accomplished by flexing or manually twisting the tray.

Figure 1:
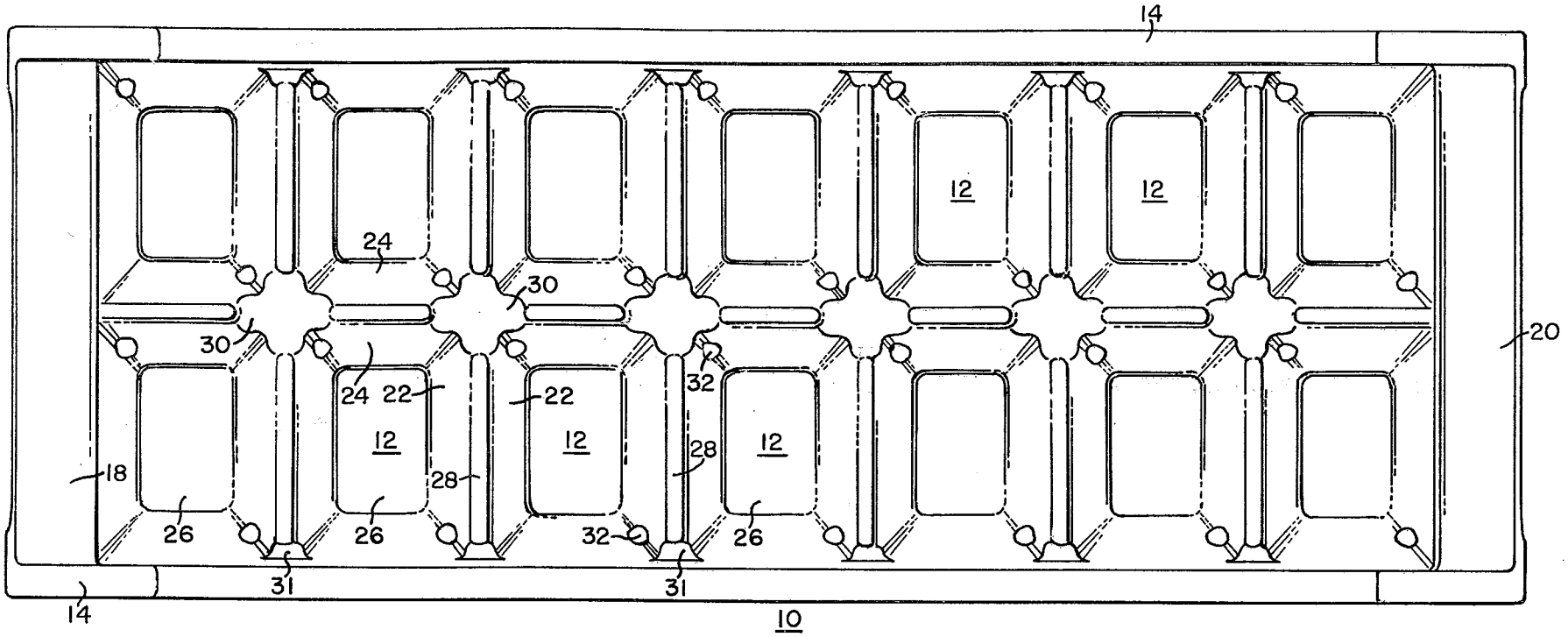
FIG. 1 is a top plan view of an ice cube tray of the present invention.
Figure 2:
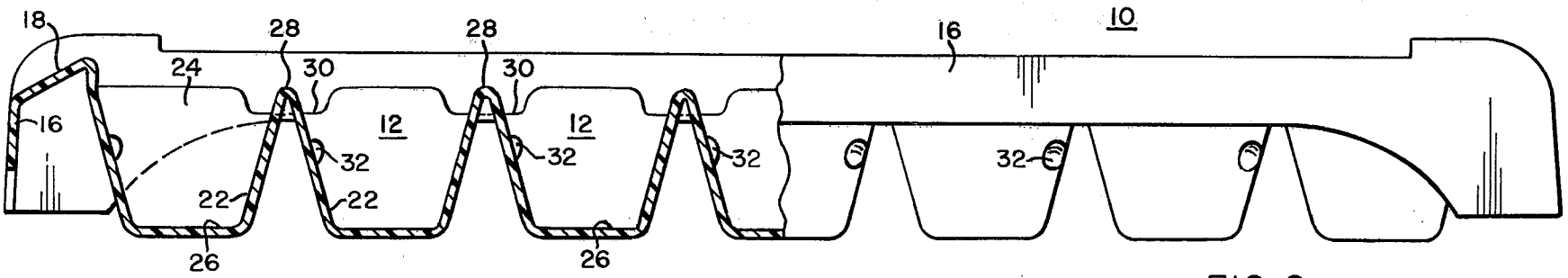
FIG. 2 is an elevational view with a portion shown in cross section of the tray of FIG. 1.

Referring now to FIG. 1, the specific structure of the tray 10 is shown incorporating the structure of the present invention. As therein seen, the tray 10 comprises a plurality of pockets 12 generally arranged in a grid-like pattern, such as two rows of seven as is shown. The pockets 12, in this array, are framed by a peripheral frame 14 having an outer down-turned flange 16 providing strength and rigidity to the flexible tray. The opposing ends 18, 20 of the frame having a generally broadened flat area which, in addition to displacing the downwardly extending flange a desired distance outwardly from the adjacent pockets for facilitating gripping of the flange at the opposite ends of the tray, provides an area against which the palm or fingers of the hands of the user press in generally opposite directions about the center line to flex the tray and crack the ice from the pockets.

Each individual pocket 12 is generally cubical having side walls 22, 24 that diverge slightly outwardly upwardly and a planar bottom wall 26. The opposed facing walls (22, 22 or 24, 24) of adjacent pockets converge in a common rounded top 28 separating each pocket. The common corner juncture 30 of each cluster of four pockets is depressed below the rounded tops otherwise separating the pockets as are the tops 28 adjacent the frame 16 (as at 31) to provide water flow path between each adjacent pocket so that as one pocket is filled to a level reaching this height, the water flows over the depressed juncture into the next pocket and thus, the tray can be filled to a common depth in all pockets that is slightly above the height of the depressed portion.

The improvement of the present invention comprises protruberances 32 extending inwardly (with respect to each pocket) from diagonally opposing junctures or corners of adjoining side walls 22, 24 of each individual pocket. These protruberances 32 are disposed in generally the upper portion of each pocket yet below the depressed portions 30 and 31 above described, and are preferably molded into the corners during the time the tray is molded. However, such protruberances can be subsequently formed in the above described trays as by pressing the back side of the corners of each pocket with a properly shaped and sufficiently heated tool.

In that these protuberances 32 are disposed within the corner structure of adjoining side walls, which is an area generally structurally rigid with respect to the planar area of the walls, they are not easily cammed or flexed out of an interfering contacting engagement with an ice cube formed therein. Further it is seen that the forces transmitted to the cube through these protuberances are received by the cube in a relatively sharp angled corner. The force thus received by the cube in this area cannot be easily distributed but remains generally concentrated thereat. The net result of the relatively non-flexibility of the pocket in the corner area and the concentration of forces on the cube at the corner result in a high localized stress when the tray is flexed to release the ice cubes therefrom.

Figure 3:
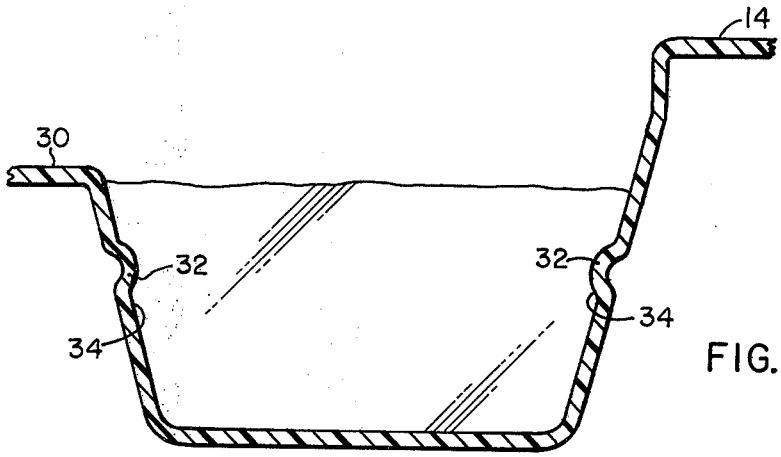
FIG. 3 is a cross sectional elevational view across opposing corners of an ice cube molding pocket of the tray of FIG. 1.

Thus, referring to FIG. 3, the cross sectional shape of the pocket and the frozen ice cubes therein is seen. The corner protuberances 32 extend inwardly towards each other and have a generally rounded configuration that provides an interfering area 34 in the cube immediately subadjacent each protuberance 32 that might either be broken from the cube or that must cam the corner construction of the pocket 12 out of the way of the cube before the cube can be ejected (or a combination of the above). These protruberances 32 extend at least sufficiently so that whatever flexure is permitted by the corners there remains at least some interference engagement that causes the ice to be somewhat deformed or fractured before it is permitted to pass.

Figure 4:
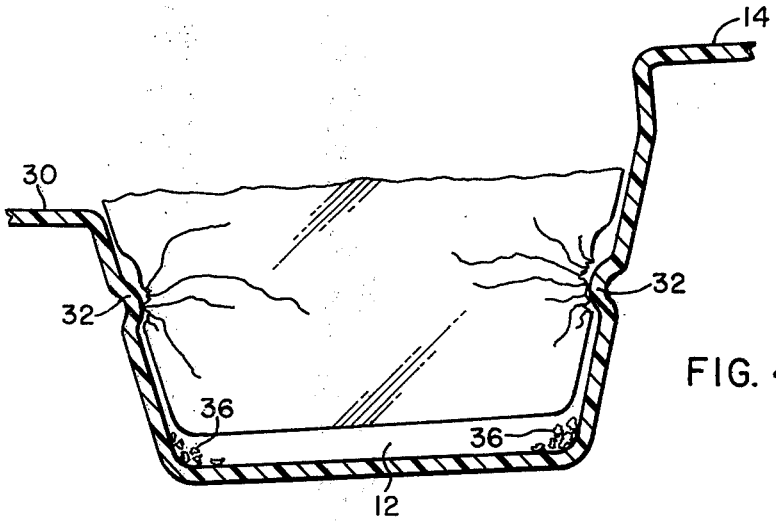
FIG. 4 is view similar to FIG. 3 showing the ice cube in the pocket and the pocket in a flexed position to release the cube; and, FIG. 5 is a view similar to FIG. 3 with the cube in a released position.
Figure 5:
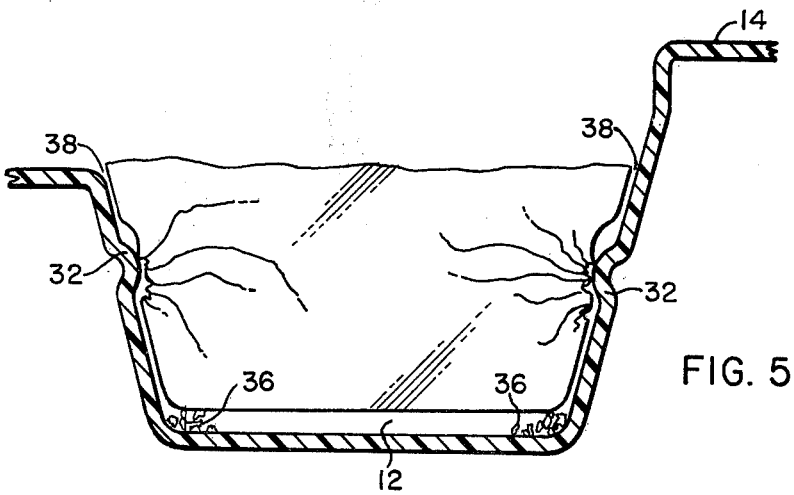

Referring now to FIG. 4, the relative relationship of the pocket 12 with respect to the cube is shown during the time when a tray is flexed or twisted so as to release the cube. This twisting or flexing establishes a stress concentration in the cube that ultimately results in fracturing the cube (as shown) to the extent necessary to alter its configuration to permit it to pass the protuberances 32. This alteration takes on many variations including limited displacement of certain areas of the cube to some extent and also causing flaking and chipping 36 of the cube along its corner with the chips generally retained in the pocket. However, to the extent that the cube is altered by these various ways, it is prevented from becoming reseated in the pocket in the as-molded condition upon the pocket returning to its initial configuration when the twisting is released as seen in FIG. 5. The end result is that each individual cube remains in a generally elevated position subsequent to being released from the pocket by the above flexing and, in such position, provides a space 38 between the walls of the cube and the pocket and facilitates manual removal of each individual cube.

What is claimed is:

1. A unitarily molded flexible plastic ice cube tray comprising a generally rectangular member having a peripheral framing flange encircling a plurality of pockets for receiving water to be formed into individual ice cubes when frozen, each of said pockets having a generally cubical configuration with upwardly outwardly diverging side walls and wherein the improvement comprises:

means projecting inwardly from opposite areas of said side walls for establishing areas of stress concentration in said ice cube when said tray is deformed to release the ice cubes from said pockets, said projections thereby causing a splintering and cracking of said ice cube to the extent that the cube is prevented from reseating itself within the tray in the as-molded relationship whereby manually gripping each individual cube for removal from said pocket is facilitated.

2. Structure according to claim 1 wherein said inwardly projecting means are disposed in a pair of diagonally opposed corners of said side walls.

3. Structure according to claim 2 wherein said tray includes depressed areas in the common uppermost juncture of adjacent pockets to provide flow communications from a pocket that has been filled to this level to the adjacent pocket, said inwardly projection means disposed below said depressed areas and generally above the center of said pocket.

4. Structure according to claim 2 wherein said inwardly projecting means are unitarily molded with and form a part of the walls of said pockets and extend into the pocket with sufficient rigidity to prevent outward passage of the ice cube formed in said pocket without first fracturing the cube.

* * * * *

UNITED STATES PATENT AND TRADEMARK OFFICE

CERTIFICATE OF CORRECTION

PATENT NO. : 3,930,376

DATED : January 6, 1976

INVENTOR(S) : Anton J. Schwartz

It is certified that error appears in the above-identified patent and that said Letters Patent are hereby corrected as shown below:

In the Abstract, line 13, change "interferring" to --interfering--.

Column 2, line 1, after "is" insert --a--.

Column 4, line 3, change "and" second occurrence to --that--.

Column 4, lines 29 and 30, change "communications" to --communication--.

*Column 4, line 31, change "projection" to --projecting--.

Signed and Sealed this twentieth Day of April 1976

[SEAL]

Attest:

RUTH C. MASON
*Attesting Officer*

C. MARSHALL DANN
*Commissioner of Patents and Trademarks*